United States Patent [19]

Calkins

[11] Patent Number: 4,951,924

[45] Date of Patent: Aug. 28, 1990

[54] DEEPWATER SUBSEA LOWERING/LIFTING SYSTEM

[75] Inventor: Dennis E. Calkins, Houston, Tex.

[73] Assignee: McDermott International, Inc., New Orleans, La.

[21] Appl. No.: 408,933

[22] Filed: Sep. 14, 1989

Related U.S. Application Data

[63] Continuation of Ser. No. 312,160, Feb. 21, 1989, abandoned, which is a continuation of Ser. No. 150,802, Feb. 1, 1988, Pat. No. 4,838,522.

[51] Int. Cl.[5] ..... B66C 1/00; B66D 1/00; B66D 3/08

[52] U.S. Cl. ..... 254/337; 212/259; 254/387; 254/399

[58] Field of Search ..... 254/242, 266, 277, 337, 254/387, 389, 390, 391, 393, 399, 408, 384, 385, 386, 257, 259, 260; 212/191, 223, 242, 259; 294/102.1; 188/65.1, 65.2, 65.3

[56] References Cited

U.S. PATENT DOCUMENTS

| | | | |
|---|---|---|---|
| 467,529 | 1/1892 | Victor | 254/277 X |
| 873,090 | 12/1907 | Rigby | 294/102.1 X |
| 2,293,936 | 8/1942 | Crooke | 254/337 X |
| 2,833,118 | 5/1958 | Nixon | 254/384 X |
| 3,856,267 | 12/1974 | Flannelly | 254/277 X |
| 4,446,807 | 5/1984 | Johnson et al. | 254/277 X |
| 4,641,816 | 2/1987 | Kishida et al. | 254/257 X |

FOREIGN PATENT DOCUMENTS

| | | | |
|---|---|---|---|
| 57622 | 8/1982 | European Pat. Off. | 254/384 |
| 877129 | 5/1953 | Fed. Rep. of Germany | 254/384 |
| 2290385 | 6/1976 | France | 254/257 |
| 8602916 | 5/1986 | PCT Int'l Appl. | 254/384 |

*Primary Examiner*—Joseph J. Hail, III

*Attorney, Agent, or Firm*—Robert J. Edwards; Michael L. Hoelter

[57] ABSTRACT

Fixed and traveling cable blocks along with first and second cable grip assemblies are supported adjacent the load to be lifted or lowered. A lifting/lowering cable is threaded through the cable grip assemblies before being secured to the load while a separate cable suspends the traveling block from the fixed block. By alternately closing one cable grip and opening the other, the load becomes movable upon the movement of the travelling block. Additionally, by closing the previously opened cable grip and opening the previously closed cable grip, the traveling block may be re-positioned or re-cycled while the load remains stationary. Upon such re-positioning, the lowering/lifting operation of the load can be repeated.

3 Claims, 12 Drawing Sheets

Clamps 32 open

DEEPWATER SUBSEA LOWERING/LIFTING SYSTEM

This is a continuation of application Ser. No. 312,160 filed Feb. 21, 1989, now abandoned, which is a continuation of application Ser. No. 150,802 filed Feb. 1, 1988, now U.S. Pat. No. 4,838,522 issued June 13, 1989.

FIELD OF THE INVENTION

This invention pertains to lowering and lifting structures great distances in a marine environment and more particularly to the use of cable blocks and cable grip assemblies to accomplish these tasks.

BACKGROUND OF THE INVENTION

As deeper ocean depths are developed, the need to lower as well as lift such items as wellheads, piles, tools, and pipeline systems great distances arises. Because of such depths, the speed of the object being lowered or lifted as well as its weight becomes important.

In the past and at lesser depths, barge mounted heavy lift cranes were used because they had acceptable weight capacity and speed for such distances. At greater depths, however, their many parted lines caused tangling problems and providing sufficient storage capacity for the wire rope also presented its problems.

Derrick mounted crown and traveling blocks have been used to repeatedly add/remove segments of drilling pipe to accomplish a lowering/lifting operation. This equipment has adequate weight capacity but the repetitive task of constantly adding a length of pipe or constantly removing a length of pipe, and its associated work stoppages, results in an undesirable speed rate for deepwater operations.

Fixed and traveling cable grip assemblies provide acceptable weight capacities and have the simplicity of requiring few lengths of large diameter wire rope. However, the short stroke length and slow speed at which the grips move along the cable produces a very slow lowering/lifting speed. Furthermore as water depth increases, this slower speed only increases the length of offshore time required.

It is thus an object of this invention to provide a lowering/lifting system which meets and/or exceeds required weight capacity, is simple to operate, and requires few parts of wire rope. Further objectives of this invention are to enable its operation whether it is crane mounted, deck mounted, or derrick mounted, and to maximize the use of existing installed equipment, machinery, foundations, and structural load paths. Another object is to significantly increase the lowering/lifting speed of the load. Still yet a further object is to reduce the number of parts of line normally required for greater depths so as to minimize the potential of tangled or twisted rope. These and other objects and features of this invention will become apparent upon closer investigation of this invention.

SUMMARY OF THE INVENTION

This invention pertains to a method and apparatus for lowering/lifting loads in a marine environment. First and second cable grip assemblies along with fixed and traveling blocks are supported adjacent the load to be lifted. A lowering/lifting cable unspooled from a storage/tension wheel is threaded through each cable grip assembly before being secured to the load. A separate cable that is conventionallly operated such as by a crane suspends the traveling block from the fixed block. The cable grips and the blocks are positioned such that when the first cable grip assembly engages the lowering/lifting cable while the second cable grip assembly is disengaged from such cable, the load is moved upon the movement of the traveling block. Additionally, when the second cable grip assembly engages the lowering/lifting cable while the first cable grip assembly is disengaged from this cable, the load remains stationary upon the movement of the traveling block. The load is quickly repositioned to any desired elevation by the raising or lowering movement of the traveling block and then by holding the load stationary while the traveling block is re-positioned to repeat the cycle over again.

DETAILED DESCRIPTION OF THE INVENTION

Figure 1:
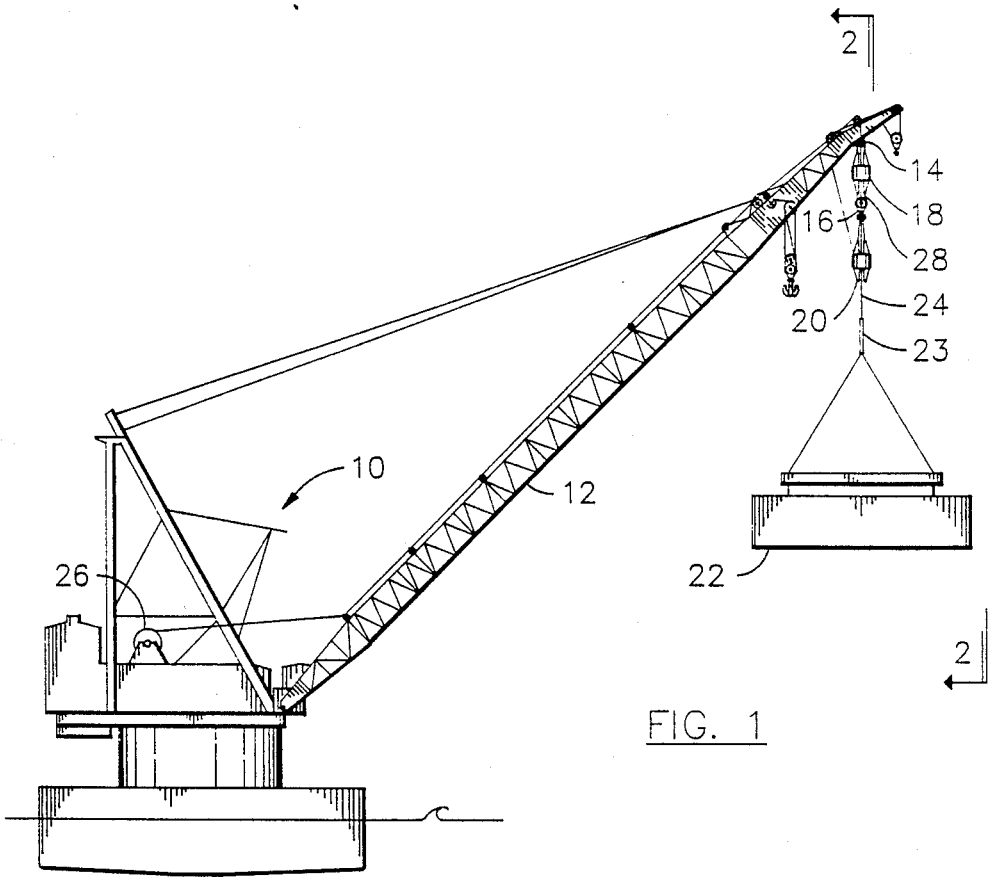
FIG. 1 is a side pictorial view of a heavy lift crane in combination with crane mounted cable grip assemblies and with the load in the raised position.
Figure 2:
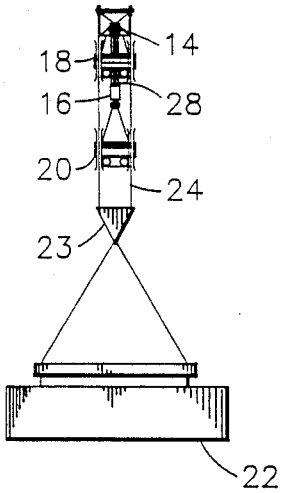
FIG. 2 is a front sectional view taken along lines 2—2 of FIG. 1 showing the cable grip assemblies with the load in the raised position.

Referring initially to FIGS. 1 and 2, there is shown typical heavy lift crane 10 with boom 12. The free end of boom 12 supports both fixed block 14 and traveling block 16. Fixed block 14 has suspended from it fixed cable grip 18 and similarly, traveling block 16 has traveling cable grip 20 suspended immediately underneath it. Load 22 is connected underneath traveling cable grip 20.

Lowering/lifting cable 24 has one end wound around storage wheel 26 which maintains a constant tension on cable 24. This cable then passes through both fixed and traveling cable grips before connecting to load equalizer block 23 which supports load 22. Separate cable 28 connects lower traveling block 16 to fixed block 14. This separate cable 28 is operated or coiled in the conventional manner by heavy lift crane 10 to either raise or lower a suspended load. By being so connected, traveling block 16 and traveling cable grip 20 suspended therefrom are movable independent of load 22 via separate cable 28.

Figure 3A:
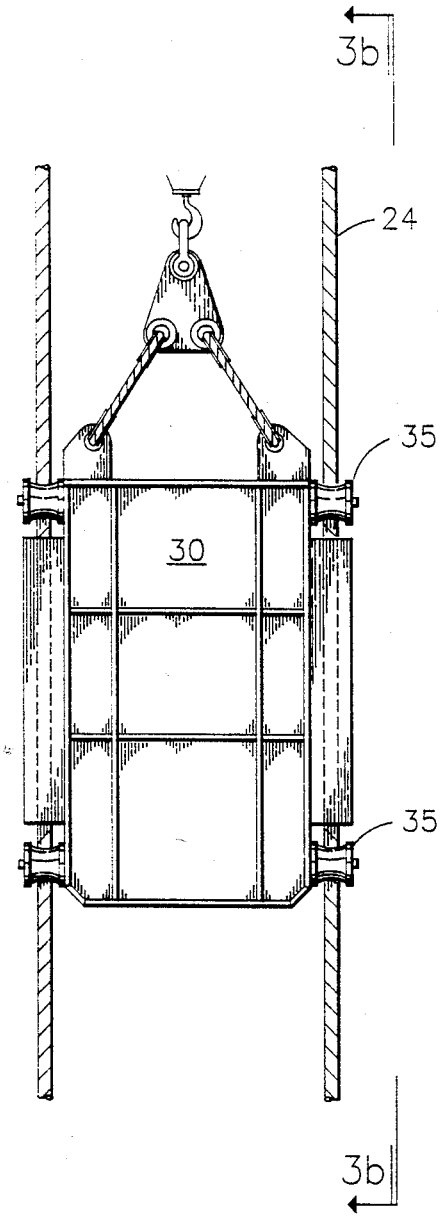
FIG. 3*a* and 3*b* are more detailed views of a typical cable grip assembly.
Figure 3B:
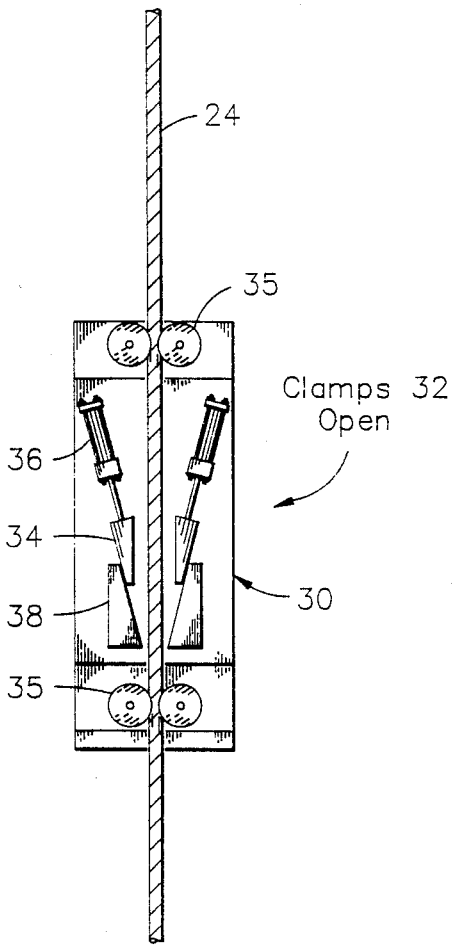

Referring now more specifically to FIGS. 3*a* and 3*b*, there is illustrated typical cable grip assembly 30. It is suspended from either fixed block 14 or traveling block 16 and lowering/lifting cable 24 passes through assembly 30 as shown. A pair of clamps 32 are mounted in each assembly 30 with each clamp 32 clamping against separate lengths of lowering/lifting cable 24. Clamp 32 consists of a pair of movable wedges 34 each connected to the end of either a hydraulically, pneumatically, or electrically operated cylinder 36. Wedges 34 are moved between angled guides 38 such that when cylinders 36 are extended, wedges 34 engage or clamp against cable 24 (the closed position) and when cylinders 36 are retracted, wedges 34 are disengaged from cable 24 (the open position). During reeving and the attachment of lowering/lifting cable 24 to load 22, clamp pairs 32 would be in the open positions so as to allow cable 24 to freely pass through both cable grips 18 and 20. Cable 24 would also pass through adjustable guide rollers 35 positioned on opposite sides of clamp 32. Guide rollers 35 maintain the proper alignment of cable 24 during the clamping and unclamping operation.

Figure 4:
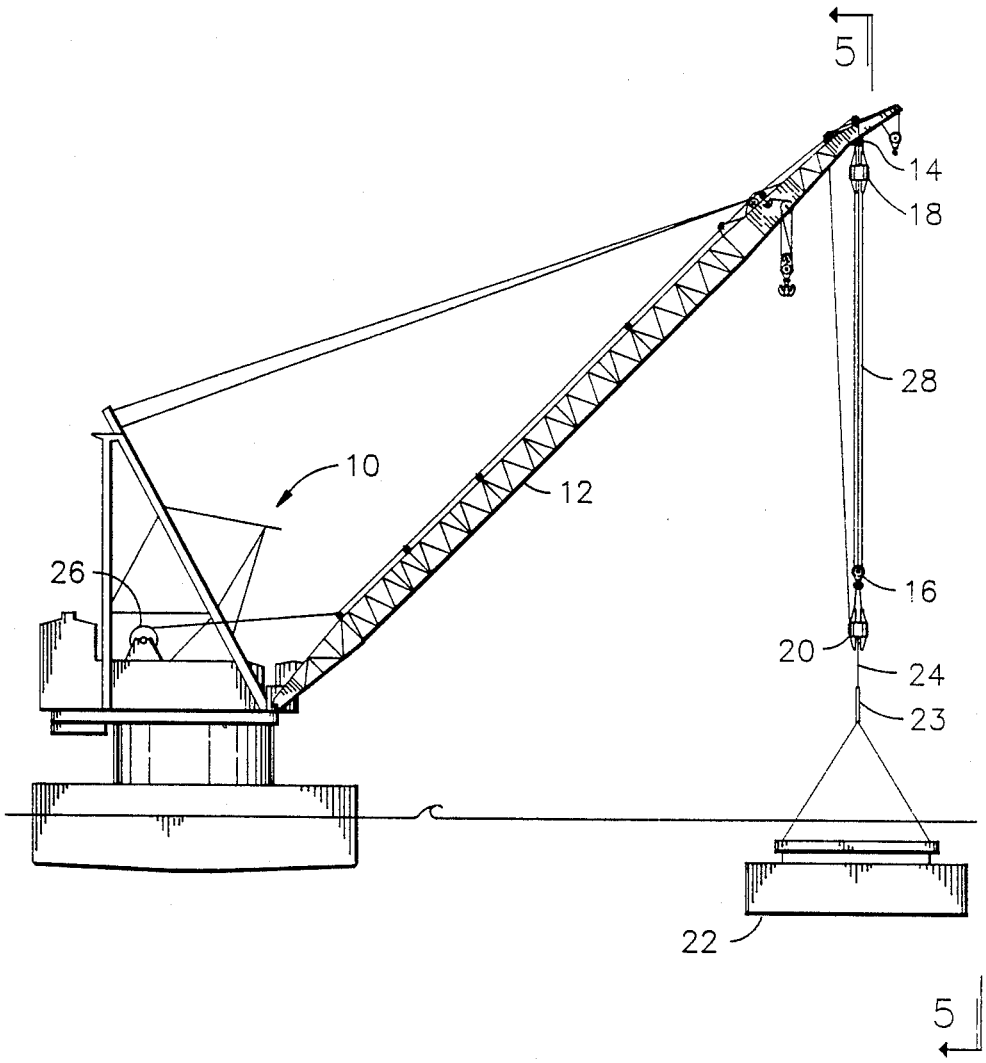
FIG. 4 is a side pictorial view similar to FIG. 1 but with the load in a lowered position.
Figure 5:
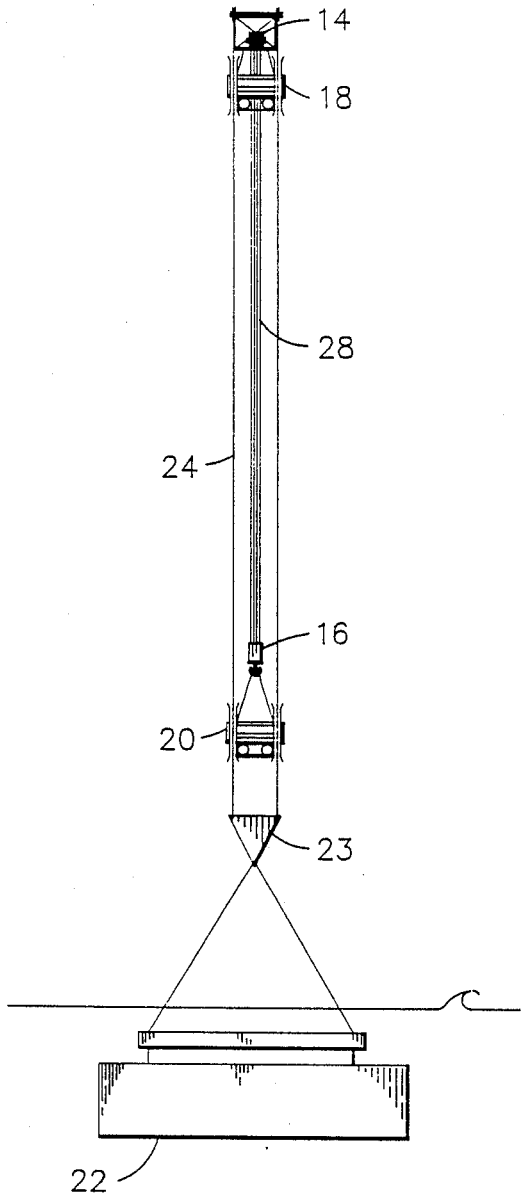
FIG. 5 is a front sectional view taken along lines 5—5 of FIG. 4 showing the cable grip assemblies with the load in a lowered position.

FIGS. 1 and 2 illustrate load 22 in the raised position while FIGS. 4 and 5 show load 22 in the lowered position. During the lowering operation, clamps 32 of traveling cable grip 20 are closed to prevent lowering/lifting cable 24 from passing through it. This effectively transfers the force of load 22, which is suspended by lowering/lifting cable 24, to traveling block 16 immediately above closed cable grip 20. Once in this configuration, crane 10 is operated in the conventional manner via separate cable 28 to lower the combination of load 22, traveling block 16 and traveling cable grip 20 an extended distance such as to the waterline (see FIGS. 4 and 5). After reaching this position, upper or fixed cable grip 18 (which was open during the previous operation) is closed around lowering/lifting cable 24 and lower or traveling cable grip 20 (which was closed during the previous operation) is opened in that order. The force of load 22 now passes through lowering/lifting cable 24 to upper or fixed cable grip 18 and consequently fixed block 14. Without disturbing the position of and no longer restraining load 22, traveling block 16 and traveling cable grip 20 are raised or "stroked" to their starting positions via separate cable 28. Afterwards, traveling cable grip 20 is once again closed and fixed cable grip 18 is again opened in anticipation of repeating this cycle until load 22 reaches the desired depth.

To lift a load, the process is reversed. Lowering/lifting cable 24 is secured to load 22 with lower traveling block 16 and hence traveling cable grip 20 positioned at their lowest elevation. Traveling cable grip 20 is then closed and fixed cable grip 18 is opened causing load 22 to be restrained by traveling cable grip 20. Afterwards, both traveling block 16 and traveling cable grip 20 are raised to their highest position via separate cable 28 and the operation of crane 10 thereby also raising load 22. Upper fixed cable grip 18 is then closed and raised traveling cable grip 20 is opened thereby transferring the force of load 22 through lowering/lifting cable 24 to fixed cable grip 18 and thus fixed block 14. After the transfer of this loading, now unloaded traveling block 16 and traveling cable grip 20 are lowered via separate cable 28 to a lower elevation while load 22 is held stationary via closed upper fixed cable grip 18 and stressed lowering/lifting cable 24. The lifting cycle is then repeated until load 22 has been raised to the desired level.

Referring now to FIGS. 6 through 9, there is illustrated an alternate embodiment of this invention wherein the cable grip assemblies are deck mounted. As shown, deck 40 of barge 42 supports heavy lift crane boom 12 suspended above both first cable grip 44 and second cable grip 46. Lowering/lifting cable 24 passes through cable grips 44 and 46 and has one end wound around storage/tension wheel 26 while the other end is secured to load equalizer block 23 which supports load 22. Between cable grips 44 and 46, lowering/lifting cable 24 passes around suspended block 50 which in turn is suspended from traveling block 16. Traveling block 16 is itself suspended by separate cable 28 from boom 12. Both separate cable 28 and lowering/lifting cable 24 are sheeved as necessary along their extended run.

Also supported on deck 40 is heave compensator 52 which contains movable internal sheeves configured to compensate for the up and down motion of barge 42 as it floats on the water surface. Fairleaders 54, secured to an end region of deck 40 act as cable guides and are designed to enable load 22 to freely swing at varying angles from lowering/lifting cable 24.

First and second cable grips 44 and 46 are similar in detail to that shown in FIG. 3 for crane mounted fixed and traveling cable grips 18 and 20. In this case, however, cable grip assembly 30 would be deck mounted rather than being crane mounted. As before, each assembly would include a pair of clamps 32 clamping against different lengths of lowering/lifting cable 24. The operation of these clamps 32 against cable 24 would be the same as they alternate between "open" and "closed" positions. During reeving and attachment of lowering/lifting cable 24, both first and second cable grips 44 and 46 would be in the open position. This open position allows cable 24 to freely pass through both grips.

Figure 6:
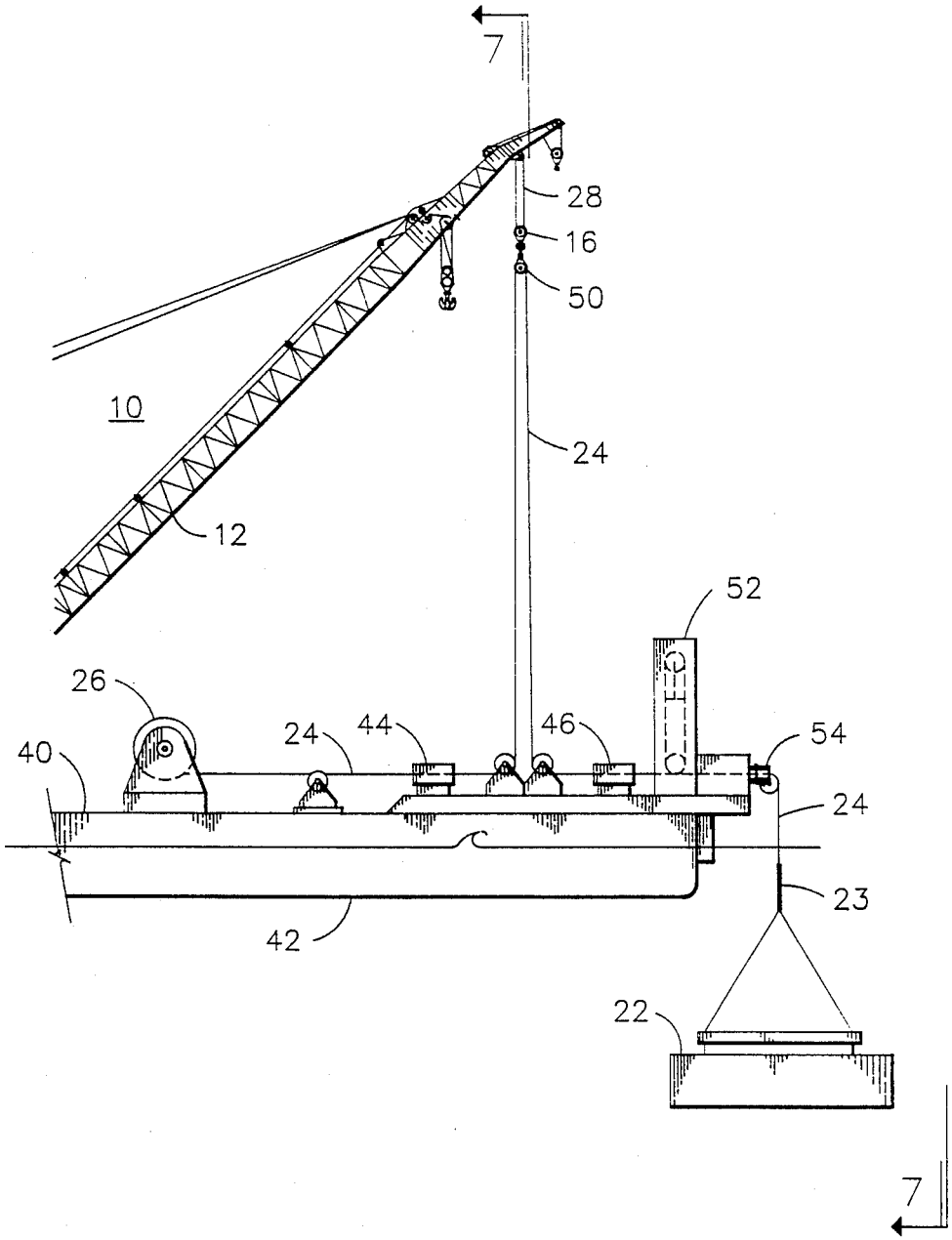
FIG. 6 is a side pictorial view of a heavy lift crane in combination with deck mounted cable grip assemblies and with the load in the raised position.
Figure 7:
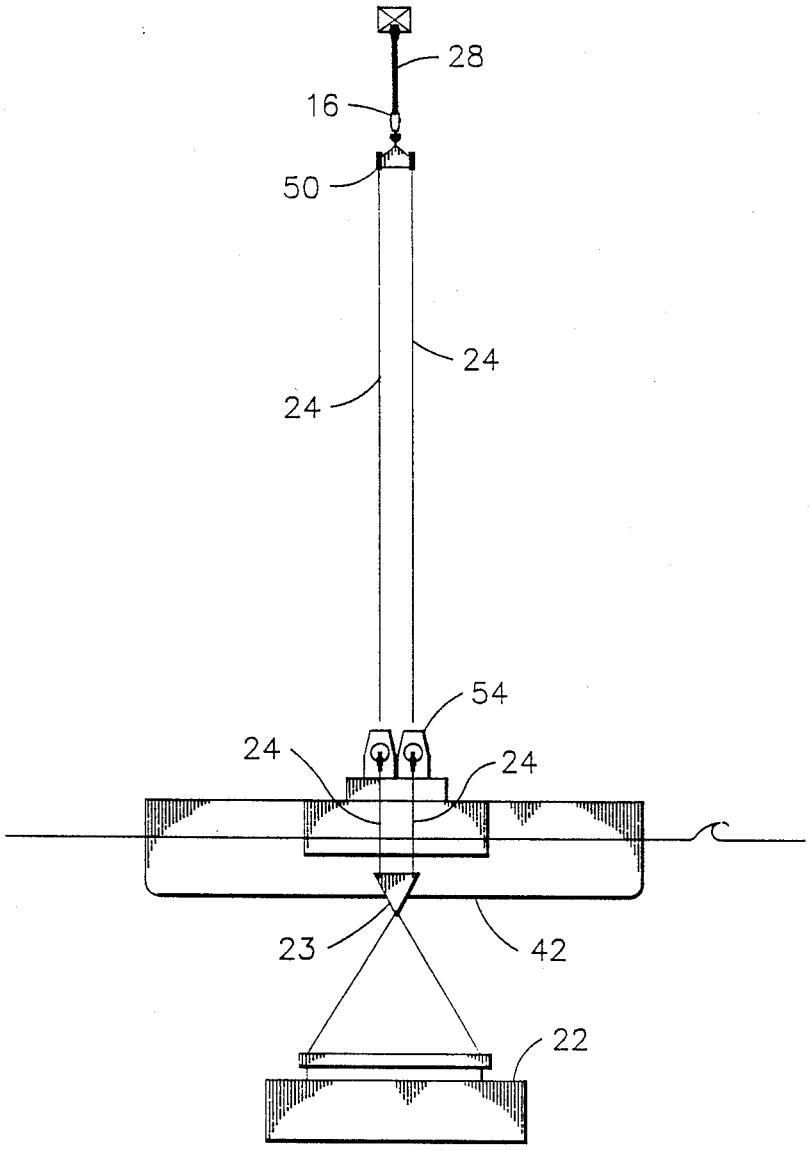
FIG. 7 is a front section view, partially cut away, taken along lines 7—7 of FIG. 6 showing the cable grip assemblies with the load in the raised position.

To lower load 22, second cable grip 46 is closed before traveling block 16 is raised to a positioned adjacent boom 12 as illustrated in FIGS. 6 and 7. In doing so, this will pull a length of lowering/lifting cable 24 off storage wheel 48 and suspend that pulled-off length from suspended block 50 between first and second cable grips 44 and 46. In the meanwhile, load 22 is being restrained through closed second cable grip 46. First cable grip 44 is then closed and second cable grip 46 is opened in that order causing load 22 to now be restrained by first cable grip 44. Traveling block 16 (and suspended block 50 which is now supporting load 22) is then lowered via separate cable 28 by conventional operation of heavy lift crane 10. With first cable grip 44 closed, as traveling block 16 is lowered, lowering/lifting cable 24 freely slides through second cable grip 46, heave compensator 52, and fairleaders 54 in that order enabling load 22 to also be lowered. Once traveling block 16 is lowered to the position shown in FIGS. 8 and 9, second cable grip 46 is closed before first cable grip 44 is opened. Load 22 is now restrained by second cable grip 46. After this load transfer, traveling block 16 is raised via separate cable 28 to its starting position adjacent the top of boom 12. During the raising of traveling block 16, additional lengths of lowering/lifting cable 24 are unwound from storage wheel 26 as needed. Upon the repositioning of traveling block 16, if load 22 is to be further lowered, then first cable grip 44 is closed and second cable grip is opened to repeat this lowering process until load 22 reaches the desired elevation.

Figure 8:
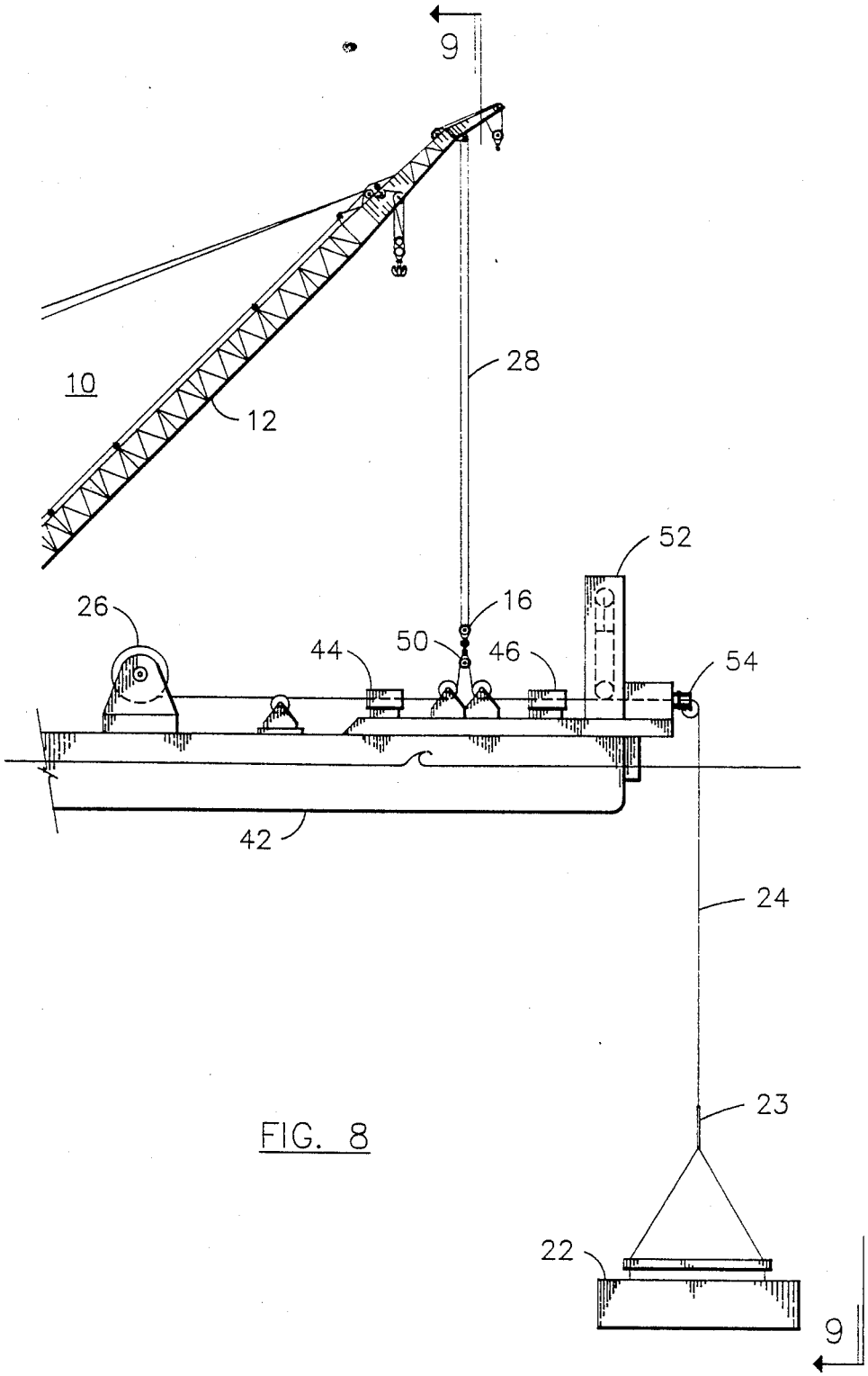
FIG. 8 is a side pictorial view similar to FIG. 6 but with the load in a lowered position.
Figure 9:
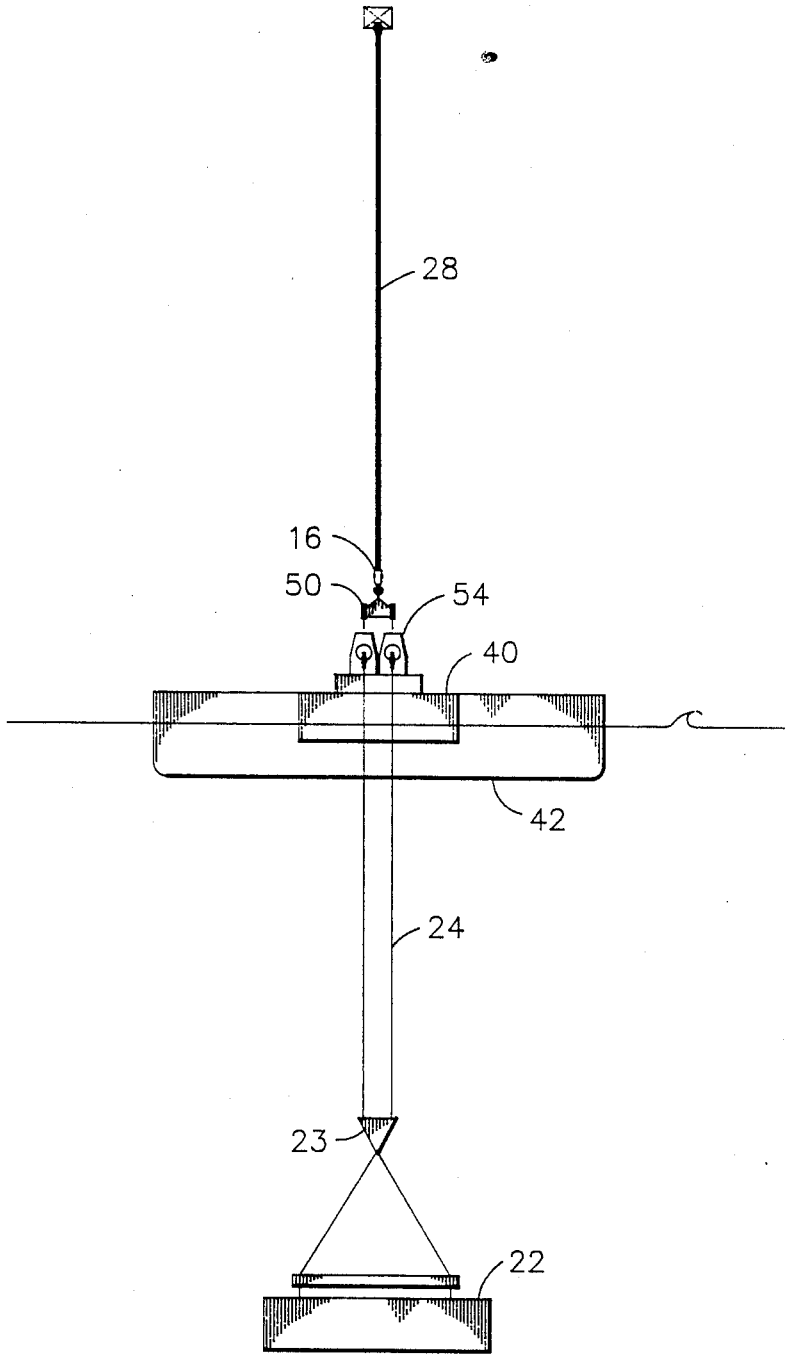
FIG. 9 is a front sectional view taken along lines 9—9 of FIG. 8 showing the cable grip assemblies with the load in a lowered position.

To raise load 22 using deck mounted cable grip, traveling block 16 is lowered to a position adjacent deck 40 as shown in FIGS. 8 and 9. In all likelihood, second cable grip 46 is closed so as to restrain load 22 during this operation. Upon lowering, first cable grip 44 is closed with second cable grip 46 being subsequently opened. Load 22 is now restrained by first cable grip 44 and traveling block 16 via lowering/lifting cable 24. Travelling block 16 is then raised via separate cable 28 to the position shown in FIGS. 6 and 7 adjacent crane boom 12. The raising of traveling block 16 with first cable grip 44 closed and second cable grip 46 open causes load 22 to be lifted via lowering/lifting cable 24. After traveling block 16 and load 22 are so raised, second cable grip 46 is closed and first cable grip 44 is opened. Closed second cable grip 46 now restrains and supports load 22 at a set elevation while traveling block 16 is lowered back to the position illustrated in FIGS. 8 and 9. During this lowering, any excess or slack in lowering/lifting cable 24 is taken up by storage wheel 26. After traveling block 16 reaches its lower position adjacent deck 40, first cable grip is closed and second cable grip is opened to repeat this lifting cycle over again if necessary.

Referring now to FIGS. 10–13, there is illustrated another embodiment of this invention wherein the cable grip assemblies are suspended from drilling derrick/mast 56. As shown, drilling derrick 56 supports crown or fixed block 14 from which separate cable 28 suspends traveling block 16 and hence traveling cable grip 20. Between traveling block 16 and cable grip 20 are idler/fleeting sheaves 60. Fixed cable grip 18 is mounted on drilling platform 62. Lowering/lifting cable 24 is wound around storage wheel 26 and idler/fleeting sheaves 60 before passing through both fixed and traveling cable grips 18 and 20. Cable 24 then connects to load equalizer block 23 which supports load 22.

Fixed and traveling cable grips 18 and 20 are detailed as shown in FIG. 3 except that in this case, traveling cable grip 20 is suspended from idler/fleeting sheaves 60 while fixed cable grip 18 is secured to drilling platform 62. The operation of these cable grip assemblies 30, however, is the same with clamps 32 alternating between open and closed positions.

During reeving and attachment of lowering/lifting cable 24, both fixed and traveling cable grips 18 and 20 would be in the open position. This enables cable 24 to freely pass through both cable grips.

Figure 10:
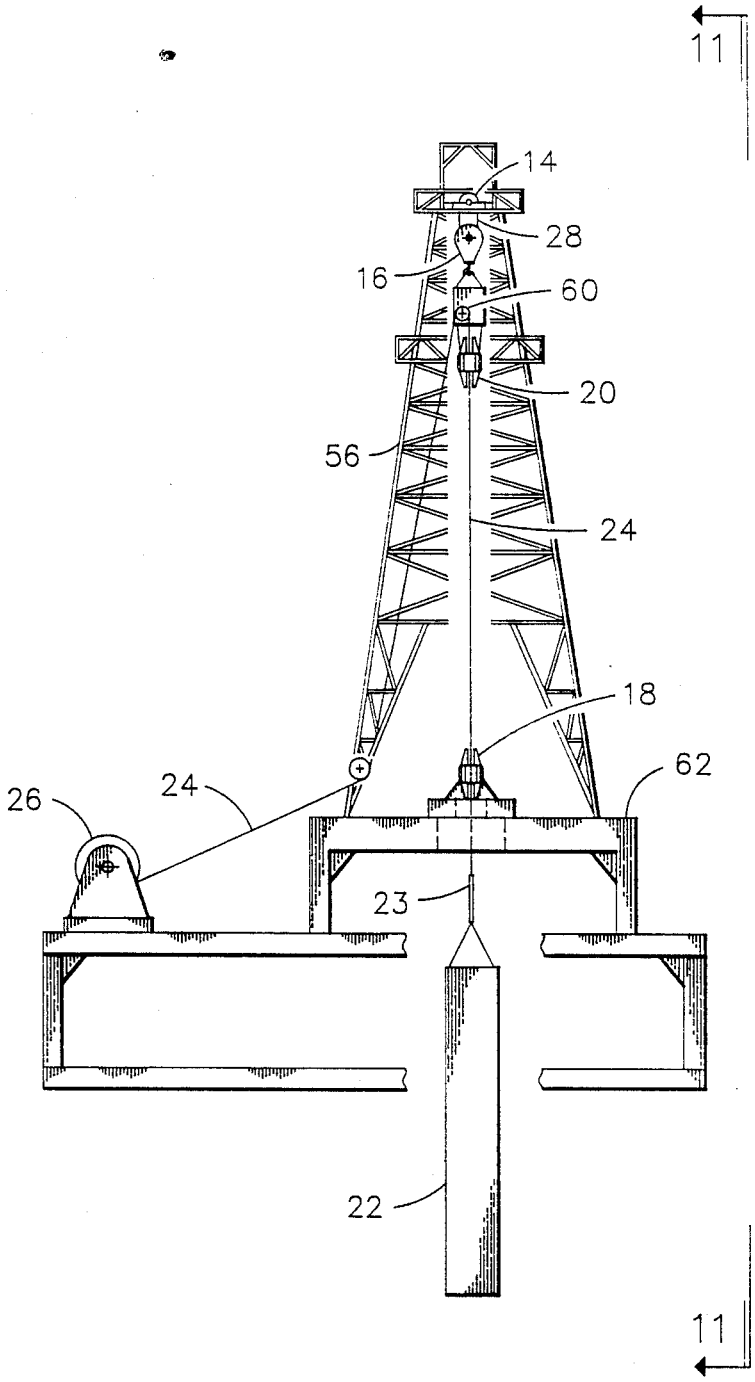
FIG. 10 is a side pictorial view partially broken away of a drilling derrick in combination with drill rig mounted cable grip assemblies and with the load in the raised position.
Figure 11:
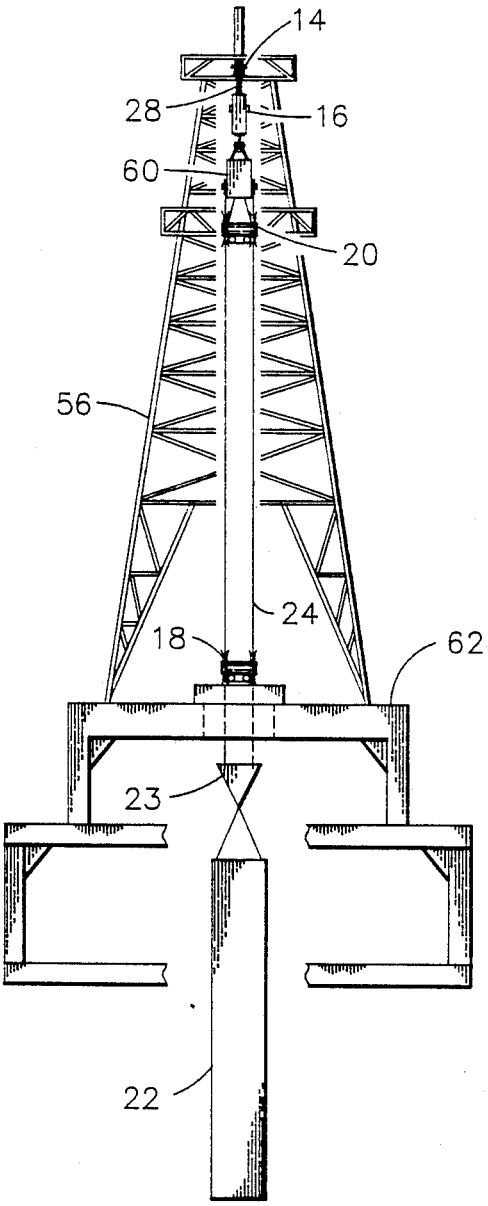
FIG. 11 is a front sectional view, partially cut away, taken along lines 11—11 of FIG. 10 showing the cable grip assemblies with the load in the raised position.

For the lowering operation, traveling cable grip 20 and traveling block 16 are positioned near the top of derrick 56 adjacent crown block 14 (see FIGS. 10 and 11). During such positioning, fixed cable grip 18 would be closed so as to restrain load 22 and should any extra lowering/lifting cable 24 be needed, it would be unrolled from storage wheel 26. After being raised, traveling cable grip 20 is closed before fixed cable grip 18 is opened. Load 22 is now restrained from traveling block 16 and traveling cable grip 20. Crown block 14 then lowers both traveling block 16 and traveling cable grip 20 via separate cable 28 thereby also lowering load 22. Upon reaching the bottom of derrick 56 (see FIGS. 12 and 13), fixed cable grip 18 is closed around lowering/lifting cable 24 and traveling cable grip 20 is opened. Separate cable 28 is then retracted to raise traveling block 16 and traveling cable grip 20 back to the starting position while lowering/lifting cable 24 is unwound from storage wheel 26. Because fixed cable grip 18 is closed during the raising of traveling cable grip 20, load 22 remains stationary until the cycle is repeated and traveling cable grip 20 is once again lowered.

Figure 12:
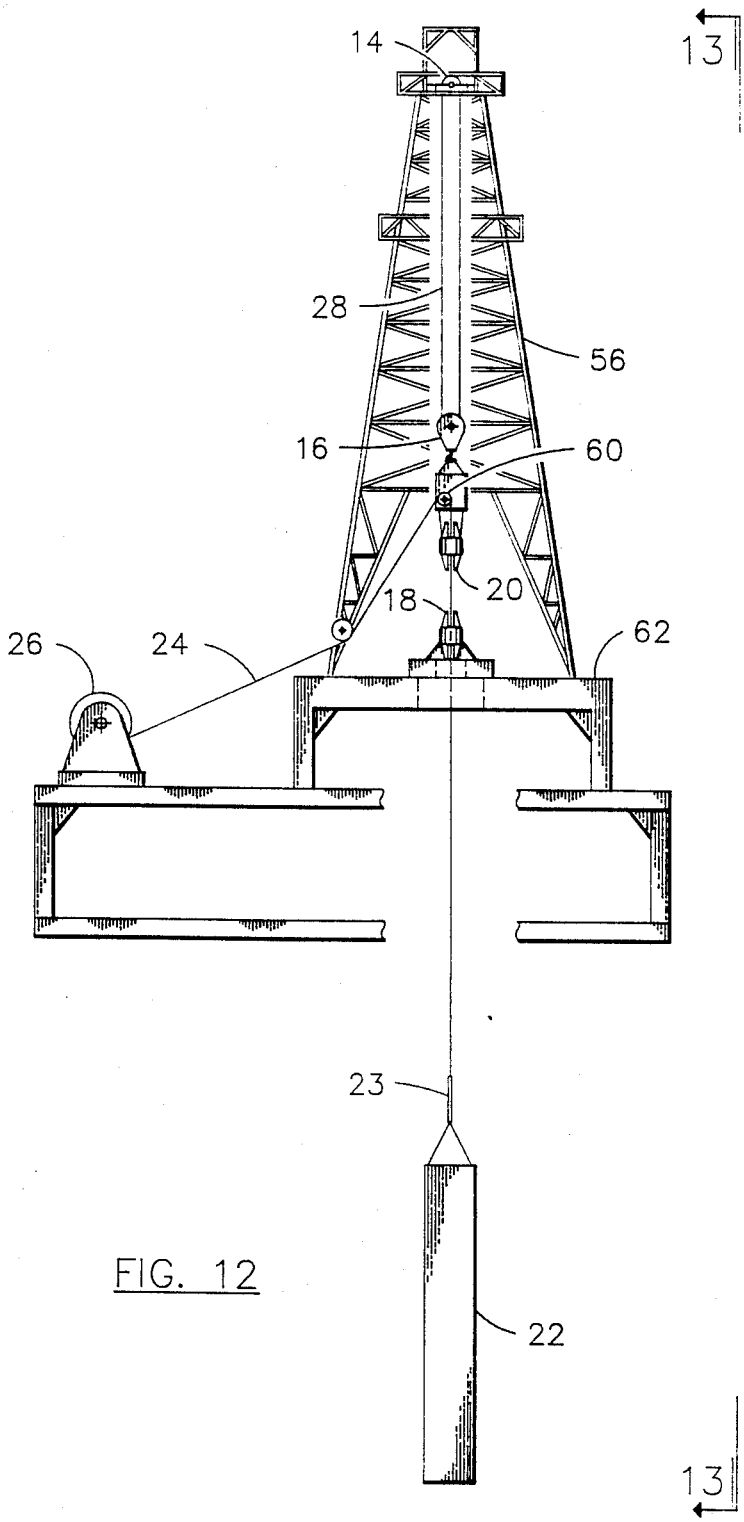
FIG. 12 is a side pictorial view, partially cut away, similar to FIG. 10, but with the load in a lowered position.
Figure 13:
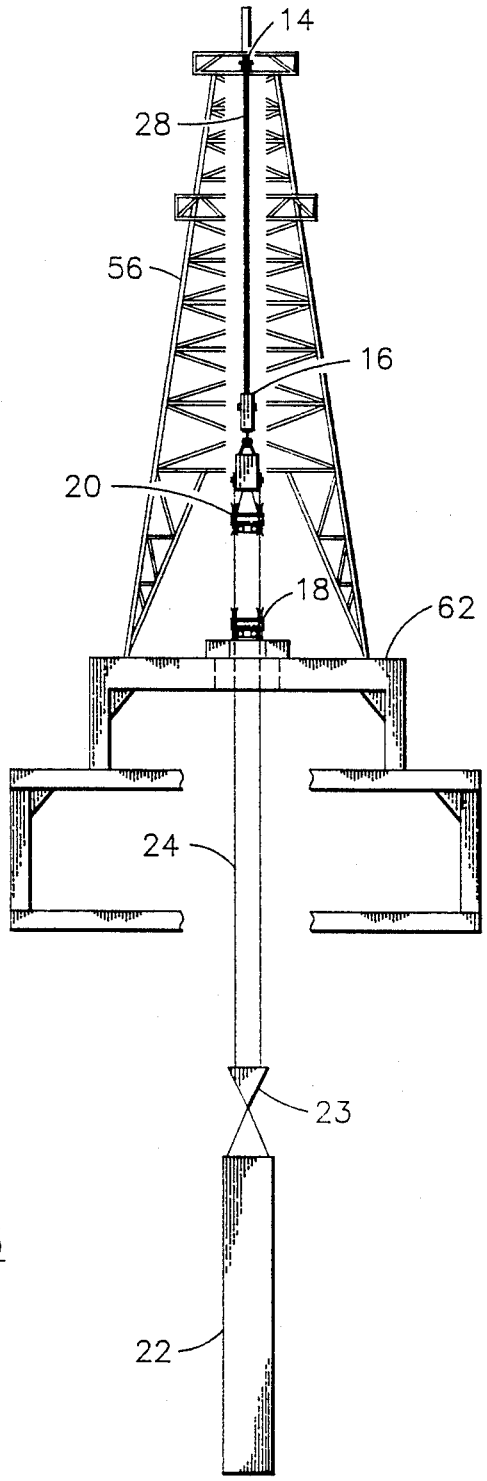
FIG. 13 is a front sectional view, partially broken away, taken along lines 13—13 of FIG. 12 showing the cable grip assemblies with the load in a lowered position.

To raise load 22, traveling block 16 is moved to its lower position as shown in FIGS. 12 and 13. Traveling cable grip 20 is then closed and fixed cable grip 18 is opened afterwhich separate cable 28 raises traveling cable grip 20 to its upper position adjacent the top of derrick 56 as shown in FIGS. 10 and 11. The raising of traveling cable grip 20 while in the closed position simultaneously raises load 22. Upon being raised, load 22 is held in place by closing fixed cable grip 18. This enables the elevated traveling cable grip 20 to be opened and then lowered back to its starting position where the cycle is repeated if necessary.

What is claimed is:

1. A lowering/lifting apparatus for intermittently deploying/retracting a tensile member in a marine environment comprising:

(a) a support from which an elongated tensile member is suspended, said support comprising the boom of a heavy lift crane;

(b) a fixed block secured to said support at a relatively fixed elevation;

(c) a traveling block suspended underneath said fixed block and independently movable with respect to said fixed block;

(d) a separate cable suspending said traveling block from said fixed block;

(e) winch means for changing the elevation of said traveling block with respect to said fixed block via said cable;

(f) a fixed grip assembly suspended from said fixed block and positioned intermediate said fixed and traveling blocks;

(g) a traveling grip assembly suspended from and movable with said traveling block;

(h) said elongated tensile member passing through said fixed and traveling grip assemblies and having one end coiled around a storage wheel, said storage wheel storing and maintaining tension on said tensile member;

(i) said fixed and traveling grip assemblies each comprising a plurality of clamps configured to selectively engage and disengage said tensile member, each said clamp comprising multiple movable wedges configured to wedge against and seize said tensile member;

(j) operating means for independently operating said fixed and traveling grip assemblies for alternate, intermittent engagement of said tensile member by said grip assemblies, said operating means operating to securely grip and support said tensile member by only one said grip assembly during the movement of said traveling block by said winch means;

(k) whereby when said traveling grip assembly engages said tensile member and when said fixed grip assembly is disengaged from said tensile member, said tensile member is deployed/retracted with respect to said support upon the deployment/retraction of said traveling block; and, (l) whereby when said fixed grip assembly engages said tensile member and when said traveling grip assembly is disengaged from said tensile member, 2. A method of intermittently deploying a tensile member in a marine environment comprising:

(a) supporting independent fixed and traveling blocks from the boom of a heavy lift crane with said traveling block being suspended from and independently movable with respect to said fixed block by a separate cable;

(b) operating said cable to change the elevation of said traveling block with respect to said fixed block;

(c) suspending a fixed grip assembly from said fixed block intermediate said fixed and traveling blocks;

(d) suspending a traveling grip assembly from said traveling block, said traveling grip assembly being movable with said traveling block;

(e) extending an elongated tensile member through said fixed and traveling grip assemblies, said tensile member having one end coiled around a storage wheel, said storage wheel storing and maintaining tension on said tensile member;

(f) raising said traveling block to a first raised position adjacent said fixed block to initiate a tensile member deployment cycle;

(g) alternately engaging and disengaging said tensile member by said fixed and traveling grip assemblies, each said grip assembly comprising a plurality of clamps with each said clamp comprising multiple movable wedges configured to wedge against and seize said tensile member;

(h) engaging said tensile member by said traveling grip assembly and subsequently disengaging said tensile member by said fixed grip assembly thereby supporting a tensile loading through said traveling grip assembly, said traveling block, said cable and said fixed block;

(i) lowering said traveling block via said cable away from said fixed block thereby also deploying said tensile member away from said boom;

(j) engaging said tensile member by said fixed grip assembly thereby restraining said tensile loading via said fixed grip assembly, said fixed block and said boom;

(k) subsequently disengaging said tensile member by said traveling grip assembly thereby disengaging said traveling block and said cable from said tensile loading;

(l) raising said disengaged traveling block via said cable independent of said tensile member back to the said first raised position adjacent said fixed block; and, (m) repeating said tensile member deployment cycle as needed.

3. A method of intermittently retracting a tensile member in a marine environment comprising:

(a) supporting independent fixed and traveling blocks from the boom of a heavy lift crane with said traveling block being suspended from and independently movable with respect to said fixed block by a separate cable;

(b) operating said cable to change the elevation of said traveling block with respect to said fixed block;

(c) suspending a fixed grip assembly from said fixed block intermediate said fixed and traveling blocks;

(d) suspending a traveling grip assembly from said traveling block, said traveling grip assembly being movable with said traveling block;

(e) extending an elongated tensile member through said fixed and traveling grip assemblies, said tensile member having one end coiled around a storage wheel, said storage wheel storing and maintaining tension on said tensile member;

(f) lowering said traveling block to a first lowered position spaced from said fixed block to initiate a tensile member retracting cycle;

(g) alternately engaging and disengaging said tensile member by said fixed and traveling grip assemblies, each said grip assembly comprising a plurality of clamps with each said clamp comprising multiple movable wedges configured to wedge against and seize said tensile member;

(h) engaging said tensile member by said traveling grip assembly and subsequently disengaging said tensile member by said fixed grip assembly thereby supporting said tensile loading through said traveling grip assembly, said traveling block, said cable, and said fixed block;

(i) raising said traveling block via said cable toward said fixed block thereby also retracting said tensile member toward said boom;

(j) engaging said tensile member by said fixed grip assembly thereby restraining said tensile loading via said fixed grip assembly and said fixed block;

(k) subsequently disengaging said tensile member by said traveling grip assembly thereby disengaging said traveling block and said cable from said tensile loading;

(l) lowering said disengaged traveling block via said cable independent of said tensile member to the said first lowered position spaced from said fixed block; and, (m) repeating said tensile member retracting cycle as needed.

* * * * *

UNITED STATES PATENT AND TRADEMARK OFFICE

CERTIFICATE OF CORRECTION

PATENT NO. : 4,951,924

DATED : August 28, 1990

INVENTOR(S) : Dennis E. Calkins

It is certified that error appears in the above-identified patent and that said Letters Patent is hereby corrected as shown below:

Claim 1, column 7, line 3, after the comma insert --said tensile member remains with respect to said support upon the movement of said traveling block.--.

Signed and Sealed this

Twenty-fourth Day of December, 1991

*Attest:*

HARRY F. MANBECK, JR.

*Attesting Officer*

*Commissioner of Patents and Trademarks*